US008864526B2

(12) United States Patent
Kim et al.

(10) Patent No.: US 8,864,526 B2
(45) Date of Patent: Oct. 21, 2014

(54) CONNECTION SOCKET FOR MOBILE TERMINAL

(71) Applicant: Tyco Electronics AMP Korea Ltd., Kyungsangbuk-Do (KR)

(72) Inventors: Jung-Hoon Kim, Seoul (KR); Jeong-Han Gong, Seoul (KR)

(73) Assignee: Tyco Electronics AMP Korea Ltd., Kyungsangbuk-Do (KR)

( * ) Notice: Subject to any disclaimer, the term of this patent is extended or adjusted under 35 U.S.C. 154(b) by 20 days.

(21) Appl. No.: 13/686,266

(22) Filed: Nov. 27, 2012

(65) Prior Publication Data

US 2013/0149906 A1 Jun. 13, 2013

(30) Foreign Application Priority Data

Nov. 28, 2011 (KR) ..... 10-2011-0125253

(51) Int. Cl.
*H01R 24/62* (2011.01)
*H01R 27/00* (2006.01)

(52) U.S. Cl.
CPC ..... *H01R 24/62* (2013.01); *H01R 27/00* (2013.01)
USPC ..... 439/638

(58) Field of Classification Search
USPC ..... 439/660, 638, 639, 79
See application file for complete search history.

(56) References Cited

U.S. PATENT DOCUMENTS

D410,629 S * 6/1999 Bandura et al. ..... D13/147
6,758,685 B1 * 7/2004 Huang et al. ..... 439/79
7,128,617 B2 10/2006 Wang et al.
7,427,217 B2 * 9/2008 Chou et al. ..... 439/660
7,607,926 B2 * 10/2009 Wang ..... 439/188
7,713,093 B2 5/2010 Kim
7,762,840 B2 * 7/2010 Hamner et al. ..... 439/541.5
7,862,346 B1 * 1/2011 Wan et al. ..... 439/79
7,909,653 B1 * 3/2011 Wan et al. ..... 439/660
7,988,495 B2 * 8/2011 Chung ..... 439/660
8,016,620 B1 * 9/2011 Chiu et al. ..... 439/660
8,038,474 B2 * 10/2011 Ju ..... 439/607.01
8,113,882 B1 * 2/2012 Chen ..... 439/607.01
8,215,996 B2 * 7/2012 Su et al. ..... 439/660
8,267,728 B2 * 9/2012 Nakaie et al. ..... 439/676
8,308,515 B2 * 11/2012 Chang ..... 439/660
8,414,331 B2 * 4/2013 Chang ..... 439/607.01
8,523,593 B2 * 9/2013 Ko ..... 439/345
2002/0048993 A1 4/2002 Chen et al.
2005/0048846 A1 * 3/2005 Suzuki et al. ..... 439/660
2009/0042448 A1 * 2/2009 He et al. ..... 439/650
2009/0186528 A1 * 7/2009 Chen ..... 439/660
2010/0173529 A1 * 7/2010 He et al. ..... 439/660
2011/0059656 A1 * 3/2011 Tsai ..... 439/660
2012/0077390 A1 * 3/2012 Tsai ..... 439/660
2012/0231671 A1 9/2012 Kim
2013/0035001 A1 * 2/2013 Yen et al. ..... 439/660
2013/0059479 A1 * 3/2013 Ho ..... 439/639

* cited by examiner

*Primary Examiner* — Alexander Gilman
(74) *Attorney, Agent, or Firm* — Barley Snyder

(57) ABSTRACT

A connection socket for a portable terminal includes a plurality of connection terminals of different types disposed in different positions on one plane in a case and connected with plug connection terminals mounted to a connection plug. Here, portions of the plurality of connection terminals to be connected with the plug connection terminals are disposed in different positions. The plurality of connection terminals are in different lengths.

15 Claims, 12 Drawing Sheets

PRIOR ART

CONNECTION SOCKET FOR MOBILE TERMINAL

CROSS-REFERENCE TO RELATED APPLICATION

This application claims the benefit of Korean Patent Application No. 10-2011-0125253, filed on Nov. 28, 2011, in the Korean Intellectual Property Office, the disclosure of which is incorporated herein by reference.

BACKGROUND

The present invention relates to a connection socket for a portable terminal, and more particularly, to a connection socket for a portable terminal, in which at least two types of connection terminals are connected with two types of connection plugs and are disposed on a same plane so that the overall thickness is reduced.

Generally, a portable terminal is equipped with functions including not only voice call but also video call, input and output of information, data storage, Internet communication, and the like.

Recently, such functions are more diversified and various contents are applied through the portable terminal. Accordingly, the portable terminal is equipped with complex functions including not only phone calling but also personal information and credit payment, photo and video taking, music and video playing, game, broadcasting reception, and the like. Also, a multimedia device may be implemented by combining those functions.

Due to the various additional functions, the portable terminal is provided with various types of connection modules corresponding to necessary sockets. The sockets and the connection modules may include a universal serial bus (USB) port for taking data in and out of a mobile communication terminal as desired by a user, and an input and output port for connection of an input and output device interfacing signals of an earphone, a remote controller, a television (TV), and the like.

Referring to FIG. 7 showing a connection module for a portable terminal, conventionally, to implement connection of various types of input and output ports with a single socket, a step 2 is formed in a case 1 so that different types of connection terminals 3 and 4 may connect with the socket without interfering with each other. The connection terminals 3 and 4 are arranged separately and alternately at an upper portion and a lower portion of the step 2 to be connected with two types of plugs.

In addition, any one of the different connection terminals 3 and 4, for example the connection terminal 3, may be a movable terminal moving up and down while being connected with a plug connection terminal of a plug inserted in the socket.

Therefore, when the plug is inserted in the socket, the plug connection terminal may be connected with the connection terminal 4 disposed at the upper portion or the connection terminal 3 disposed at the lower portion of the case 1 with respect to the step 2. Therefore, one plug may be connected with the connection terminal 4 disposed at the upper portion while another plug may be connected with the connection terminal 3 disposed at the lower portion.

SUMMARY

A conventional connection module as described above was designed to implement a socket for connection with various plugs having different functions. However, since different types of connection terminals are separately arranged at an upper portion and a lower portion with respect to a step within in one case, it becomes difficult to manufacture a slim portable terminal according to a tendency.

In addition, since one of the connection terminals of the socket is implemented by a movable terminal, the movable terminal needs to be connected after another terminal is insert-molded in the case. Therefore, manufacturing of the socket is complicated.

In particular, when the movable terminal is connected after insert-molding, not only is manufacturing complicated but also reliability of the product may be reduced due to assembly defects caused during connection of the movable terminal.

Accordingly, an aspect of the present invention provides a connection to a plug for a portable terminal, minimized in thickness although different types of connection terminals are mounted to one case.

Another aspect of the present invention is in that different types of connection terminals are arranged on one plane.

Still another aspect of the present invention is in that different types of connection terminals arranged on one plane do not interfere with each other.

Yet another aspect of the present invention is to simplify the manufacturing process of the product.

According to an aspect of the present invention, there is provided a connection socket for a portable terminal including a plurality of connection terminals of different types disposed in different positions on one plane in a case and connected with plug connection terminals mounted to a connection plug, wherein portions of the plurality of connection terminals to be connected with the plug connection terminals are disposed in different positions.

The plurality of connection terminals may be in different lengths.

The case may include a mounting case including a first mounting portion and a second mounting portion formed corresponding to the lengths of the connection terminals, and a third mounting portion extended to the first mounting portion and the second mounting portion; and a cover case configured to protect the connection terminals by enclosing the mounting case and to fix the mounting case by the third mounting portion.

The cover case may include a case fixing projection formed by cutting and bending inwardly both sides of the cover case to be inserted in the mounting case, and the third mounting portion may include a case fixing recess for insertion of the case fixing projection.

Here, first connection terminals may be mounted to the first mounting portion, second connection terminals may be mounted to the second mounting portion, and the first connection terminals may be formed shorter than the second connection terminals.

The first connection terminals may be disposed along both sides of the second connection terminals, respectively.

The mounting case may include ribs protruding between respective ones of the first connection terminals and the second connection terminals.

The second mounting portion may include a cover rib extended at an upper surface of the second connection terminals in the same length as the first connection terminals to cover the upper surface of the second connection terminals.

The mounting case may include an entry prevention projection protruding downward from an upper inner surface to guide an entry position of the connection plug.

The mounting case may be insert-molded so that the plurality of connection terminals are mounted to the mounting case.

The connection socket may be engaged with the connection plug in which the plug connection terminals connected with the plurality of connection terminals are disposed on one plane.

BRIEF DESCRIPTION OF THE DRAWINGS

These and/or other aspects, features, and advantages of the invention will become apparent and more readily appreciated from the following description of exemplary embodiments, taken in conjunction with the accompanying drawings of which.

DETAILED DESCRIPTION

Figure 1:
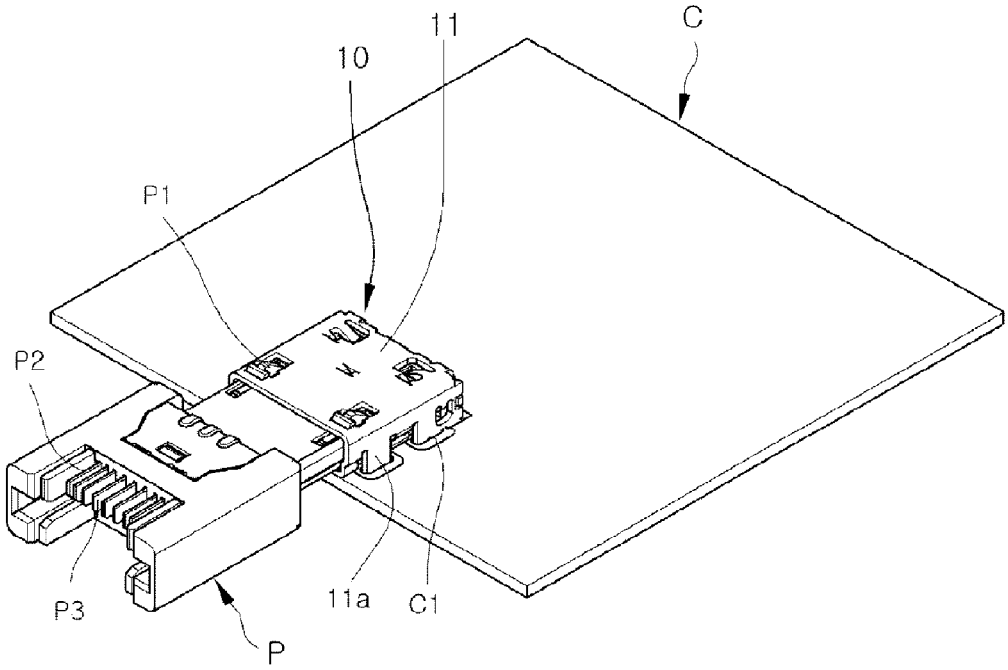
FIG. 1 is a diagram illustrating a state for inserting a plug in a connection socket for a portable terminal according to the present invention.

Reference will now be made in detail to a card mounting socket for a portable terminal according to exemplary embodiments of the present invention, examples of which are illustrated in the accompanying drawings, wherein like reference numerals refer to the like elements throughout.

Figure 2:
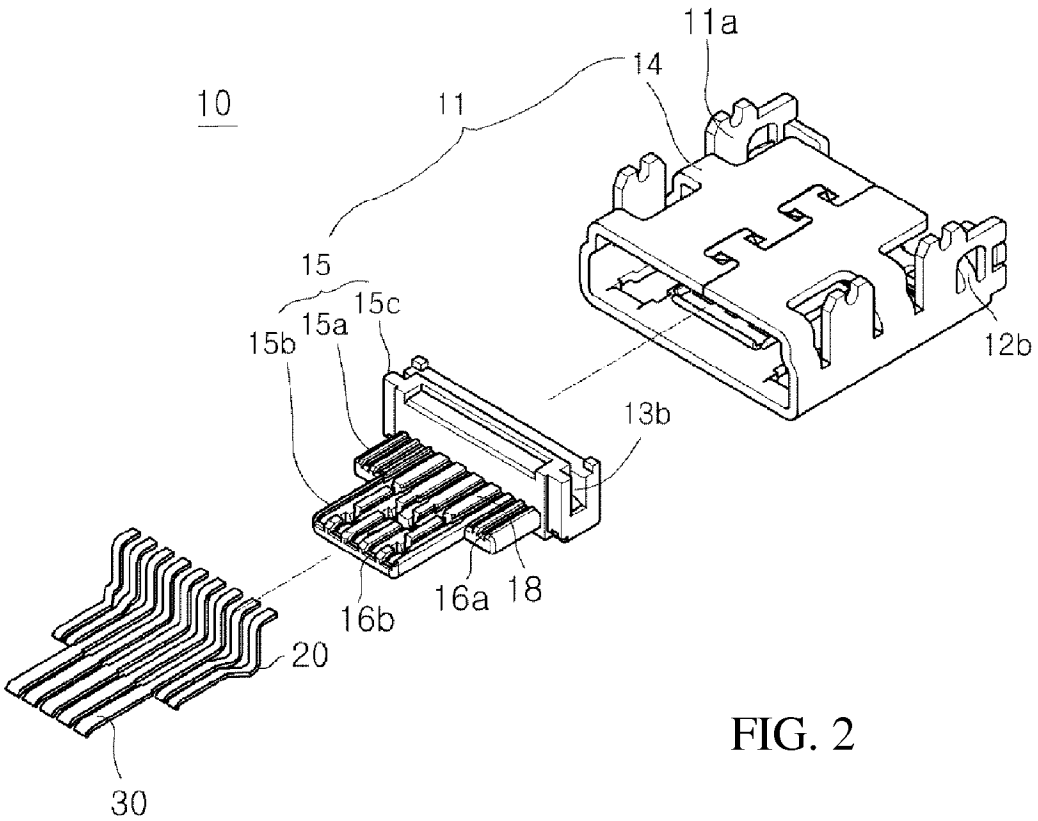
FIG. 2 is an exploded perspective view of the connection socket for a portable terminal according to the present invention.

FIG. 1 is a diagram illustrating a state for inserting a plug in a connection socket 10 for a portable terminal according to the present invention. FIG. 2 is an exploded perspective view of the connection socket 10 according to the present invention.

As shown in the drawings, the connection socket 10 may be fixed to and electrically connected with a circuit board C. The connection socket 10 may include connection terminals connected with a connection plug P upon insertion of the connection plug P to transmit signals of the connection plug P. Here, the connection terminals may be mounted in a case 11 and be in various types so that various types of connection plugs P may be connected with one connection socket 10.

The case 11 may include a coupling piece 11*a* protruding downward to be inserted in an insertion hole C1 formed on the circuit board C.

Referring to FIG. 2, the case 11 may include a cover case 14, and a mounting case 15 fixed in the cover case 14 to mount first and second connection terminals 20 and 30 of different types.

The cover case 14 may be in a rectangular box shape with one side for inserting the connection plug P open to enclose and protect an outside of the mounting case 15.

The coupling piece 11*a* may be formed by cutting a part of a bottom surface of the cover case 14 to be orthogonal to both side surfaces of the cover case 14.

The mounting case 15 may be formed by insert-molding of the first and second connection terminals 20 and 30, and include a first mounting portion 15*a* to mount the first connection terminals 20, a second mounting portion 15*b* to mount the second connection terminals 30, and a third mounting portion 15*c* to fix the first mounting portion 15*a* and the second mounting portion 15*b* to the cover case 14.

The first mounting portion 15*a* and the second mounting portion 15*b* may form one plane so that the first connection terminals 20 and the second connection terminals 30 are mounted on one plane. The mounting portion 15*a* and the second mounting portion 15*b* may include first insertion grooves 16*a* and second insertion grooves 16*b*, respectively, so that the first connection terminals 20 and the second connection terminals 30 are inserted.

Here, the first connection terminals 20 and the second connection terminals 30 are of different types and different lengths.

In detail, the first connection terminals 20 and the second connection terminals 30 may be disposed on one plane, such that ends of first connection terminals 20 and the second connection terminals 30 are disposed in different positions according to the types. Therefore, the first connection terminals 20 and the second connection terminals 30 may be connected without interference with plug connection terminals P2 and P3.

For example, the first connection terminals 20 may be relatively shorter while the second connection terminals 30 are relatively longer. The first connection terminals 20 may be disposed on both sides of the mounting case 15 while the second connection terminals 30 are disposed between both sides of the first connection terminals 20.

In this case, ends of the second connection terminals 30 being relatively longer are disposed at an insertion side at which the connection plug P is inserted in the connection socket 10. Ends of the first connection terminals 20 being relatively shorter are disposed at an inside of the connection socket 10.

That is, when a front side of the connection socket 10 refers to a side at which insertion of the connection plug P starts and a rear side refers to a side at which the inserted connection plug P is connected with the connection socket 10, the second connection terminals 30 being relatively longer are disposed at the front side of the connection socket 10 and the first connection terminals 20 being relatively shorter are disposed at the rear side of the connection socket 10.

Accordingly, the first mounting portion 15*a* to mount the first connection terminals 20 may be formed short corresponding to the length of the first connection terminals 20. The second mounting portion 15*b* to mount the second connection terminals 30 may be formed long corresponding to the length of the second connection terminals 30.

Here, positions of the first connection terminals 20 and the second connection terminals 30 having the different lengths may be exchanged.

The third mounting portion 15*c* may be integrally extended from the first mounting portion 15*a* and the second mounting portion 15*b* respectively mounting the first connection terminals 20 and the second connection terminals 30, to be fixed to the cover case 14.

The cover case 14 may include case fixing projections 12*b* formed by cutting and bending inwardly both sides of the cover case 14 to be inserted in the mounting case 15, that is, the third mounting portion 15*c*. The third mounting portion 15*c* may include case fixing recesses 13*b* for insertion of the case fixing projections 12*b*.

Therefore, since the first connection terminals 20 and the second connection terminals 30 are connected with the plug connection terminals P2 and P3 of the connection plug P from a front side and a rear side of the mounting case 15, although the first connection terminals 20 and the second connection terminals 30 are disposed on one plane, interference between the first connection terminals 20 and the second connection terminals 30 may be prevented. Also, thickness of the connection socket 10 may be minimized.

In addition, the connection plug P may be connected with the connection socket 10 as various types of connection plug P, by being connected with the first connection terminals 20 mounted at the first mounting portion 15*a* or being connected with all of the first connection terminals 20 and the second connection terminals 30.

Here, the connection plug P may be a universal serial bus (USB) port or a data input and output plug.

Figure 3A:
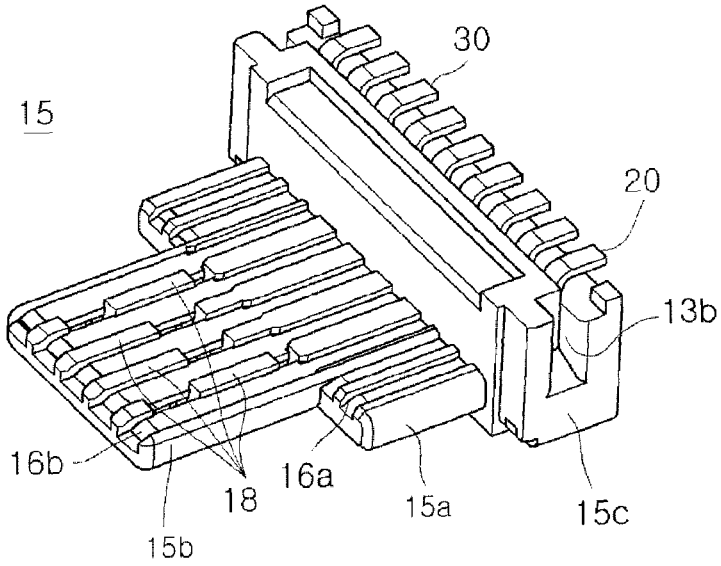
FIGS. 3A, 3B, and 3C are diagrams illustrating a connection socket for a portable terminal according to an embodiment of the present invention.
Figure 3B:
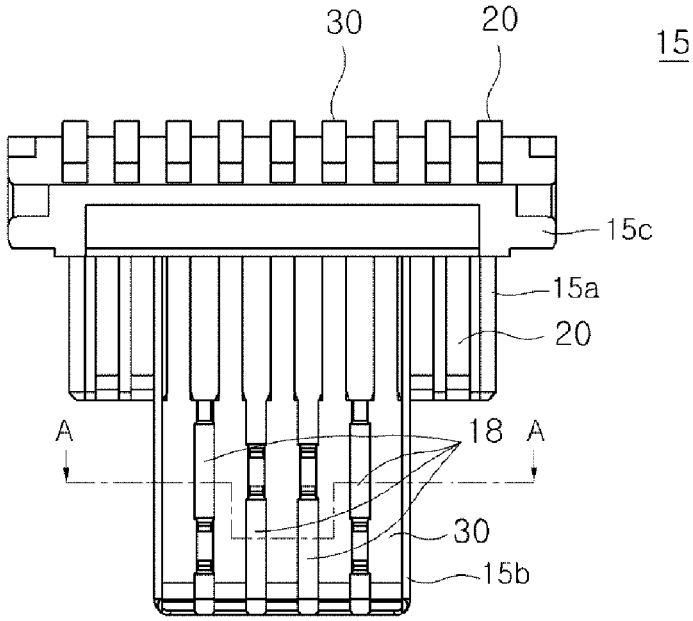
Figure 3C:
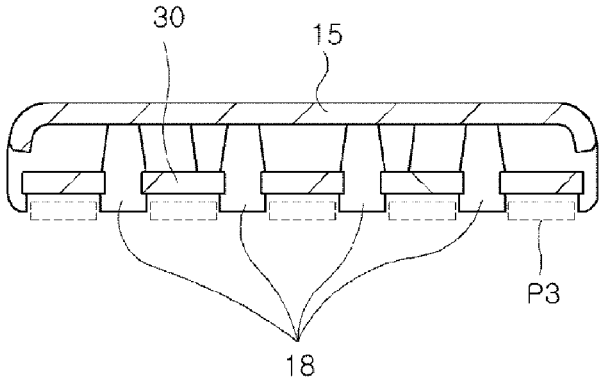
Figure 4A:
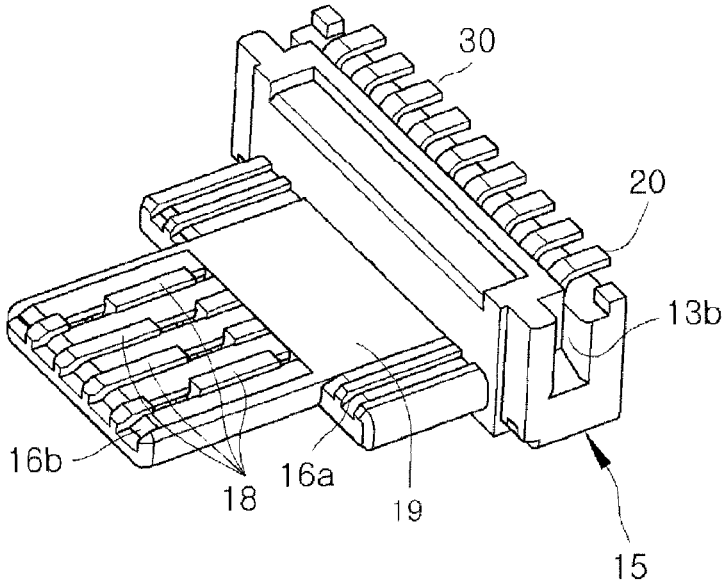
FIGS. 4A and 4B are diagrams illustrating a connection socket for a portable terminal according to another embodiment of the present invention.
Figure 4B:
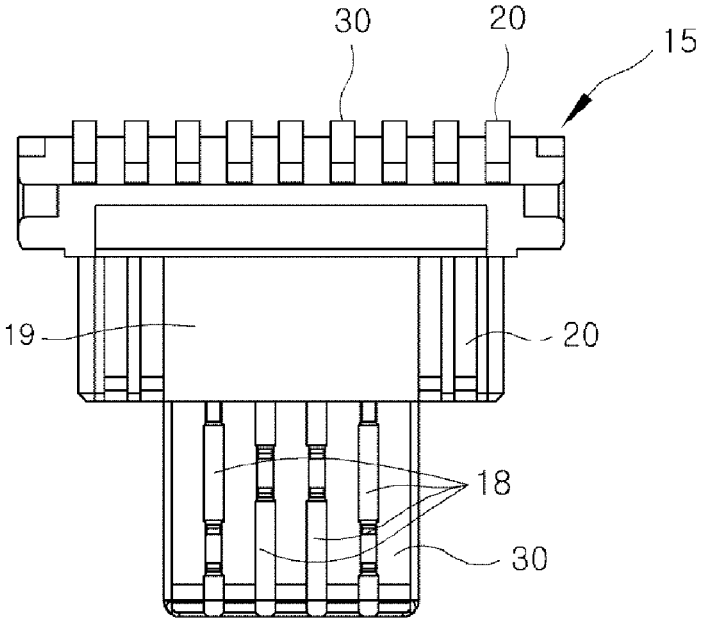

FIGS. 3A, 3B, and 3C are diagrams illustrating a connection socket for a portable terminal according to an embodiment of the present invention. FIGS. 4A and 4B are diagrams illustrating a connection socket for a portable terminal according to another embodiment of the present invention.

According to the embodiment for preventing connection terminals from escaping terminal mounting recesses 16*a* and 16*b* and interfering with each other, the mounting case 15 may include ribs 18 protruding downward between the respective ones of the first connection terminals 20 and the second connection terminals 30, thereby shorting the connection terminals 20 and 30.

In particular, referring to FIG. 3C which is a sectional view of the ribs 18 cut along a line A-A of FIG. 3B, the ribs 18 protrude between a plurality of the connection terminals to be higher than the connection terminals. Therefore, when the connection plug P is inserted in the connection socket 10, the ribs 18 may guide the respective connection terminals to be connected with respective plug connection terminals and prevent the connection terminals from escaping the terminal mounting recesses 16*a* and 16*b* and interfering with each other.

Referring to FIGS. 4A and 4B illustrating another embodiment, the ribs 18 may be provided with a cover rib 19 to cover an upper surface of relatively longer connection terminals among the connection terminals, that is, the second connection terminals 30. The cover rib 19 may be extended to the ribs 18. The cover rib 19 may have the same length as the first connection terminals 20.

The cover rib 19 is provided to reduce cost of plating for increasing conductivity of the connection terminals 20 and 30 and minimizing oxidation of the connection terminals 20 and 30. Only a part of the connection terminals 20 and 30 to be connected with the plug connection terminals is plated and a remaining part is not exposed to the outside. Therefore, oxidation may be prevented.

Accordingly, since the cover rib 19 minimizes plating of the connection terminals of the connection socket 10, manufacturing cost may be reduced.

Figure 5:
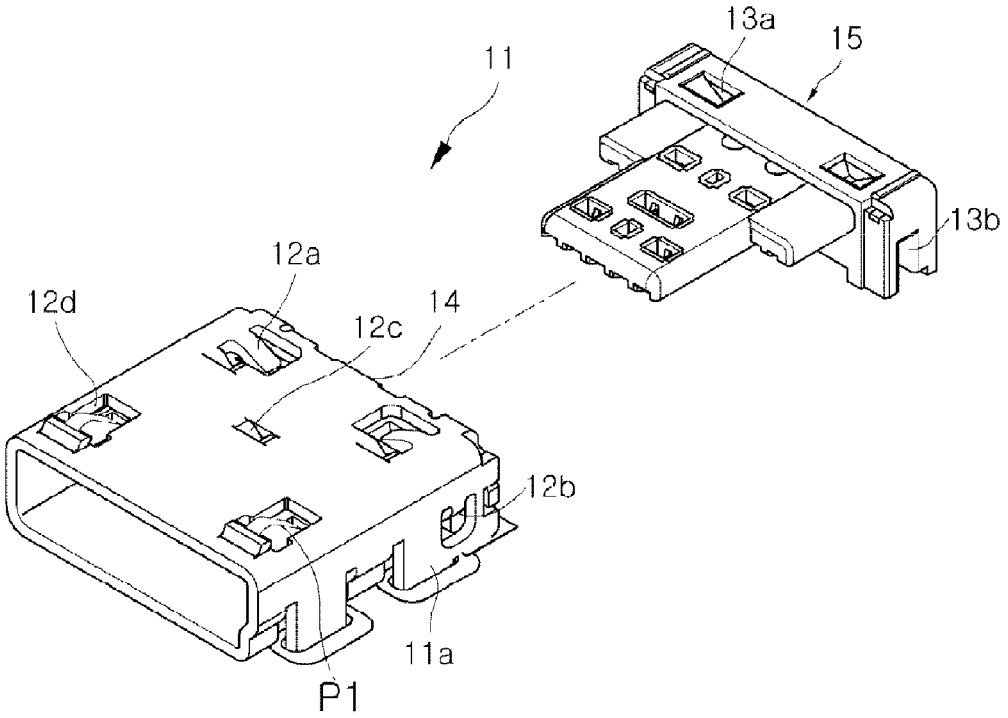
FIG. 5 is a diagram illustrating coupling relations between a case and a mounting case of the connection socket for a portable terminal according to the present invention.

FIG. 5 is a diagram illustrating coupling relations between the case and the mounting case 15 of the connection socket 10 for a portable terminal according to the present invention.

Referring to the drawing, the mounting case 15 mounting the first connection terminals 20 and the second connection terminals 30 may include an upper surface case fixing recess 13*a* formed at an upper surface and case fixing recesses 13*b* formed at both sides, to be fixed to the cover case 14. The case fixing projections 12*b* of the cover case 14 may be inserted in the case fixing recesses 13*b*.

The cover case 14 may include an upper surface case fixing projection 12*a* formed at an upper surface of the cover case 14 by partly cutting the upper surface of the cover case 14 and bending the cut portion into the cover case 14, so that the cut portion is inserted in the upper surface case fixing recess 13*a*.

In addition, the cover case 14 may include an entry prevention projection 12*c* protruding inward to guide a proper position for insertion of the connection plug P in the connection socket 10.

The entry prevention projection 12*c* may be a stopper configured to contact the connection plug P and prevent the connection plug P from being excessively inserted in the case 11 and interference between the connection terminals and breakage of the connection terminals.

Here, the entry prevention projection 12*c* may be formed at the connection socket 10 to allow the connection plug P to be inserted in a proper position in the connection socket 10 by a distance to enable the plug connection terminals and the first and second connection terminals 20 and 30 to be connected with each other without interference. In addition, connection defects may be prevented caused when the connection plug P is inserted to a degree not to contact the entry prevention projection 12*c*, that is, insufficiently inserted in the connection socket 10. The case 11 may further include a plug coupling hole 12*d* for coupling with the connection plug P being inserted.

Therefore, as the mounting case 15, in which the first connection terminals 20 and the second connection terminals 30 are insert-molded, is inserted to a rear side of the cover case 14, the upper surface case fixing projection 12*a* formed at the upper surface of the cover case 14 is inserted in the upper surface case fixing recess 13*a*. In addition, the case fixing projections 12*b* formed at both sides of the cover case 14 are inserted in the case fixing recesses 13*b* of the mounting case 15 and fixed to the cover case 14, accordingly constructing the connection socket 10.

Figure 6A:
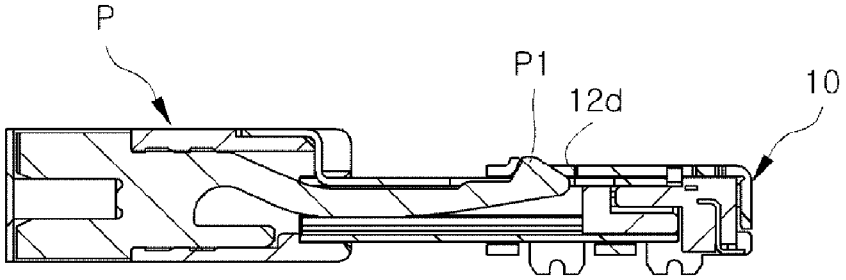
FIGS. 6A, 6B, and 6C are sectional views illustrating a state in which a connection plug is coupled with the connection socket for a portable terminal according to the present invention.
Figure 6B:
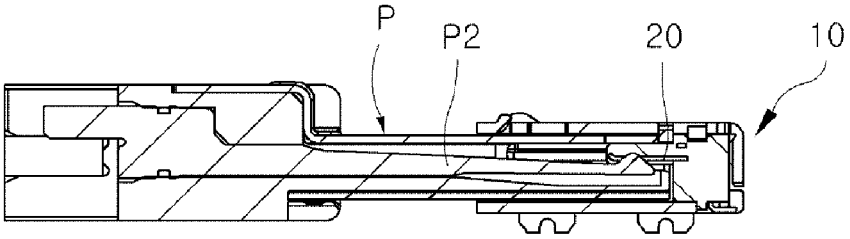
Figure 6C:
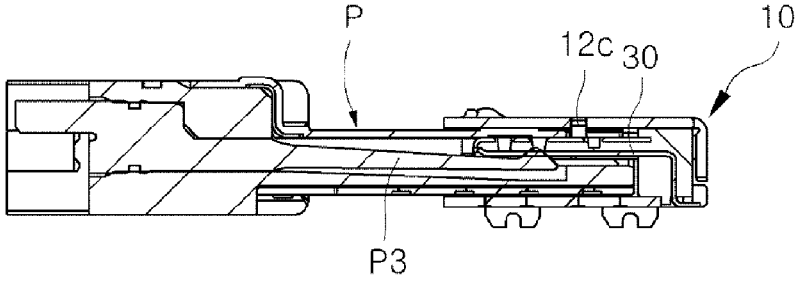
Figure 7:
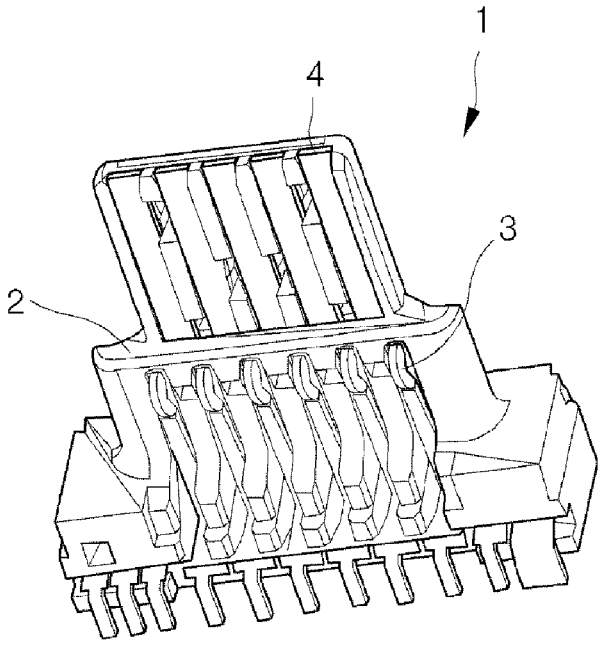
FIG. 7 is a diagram illustrating a connection module for a portable terminal according to a conventional art.

FIGS. 6A, 6B, and 6C are sectional views illustrating a state in which the connection plug P is coupled with the connection socket for a portable terminal according to the present invention.

Hereinafter, the process of connecting the connection plug P to the connection socket according to the present invention and the connected state will be described in detail with reference to the drawings.

The connection plug P is inserted in the connection socket 10 mounted on the circuit board C.

Therefore, as shown in FIG. 6A, a plug coupling projection P1 of the connection plug P may be inserted in the plug coupling hole 12*d* formed at the case 11, thereby preventing unwanted escape of the connection plug P from the connection socket 10.

In addition, as shown in FIG. 6B, the first connection terminals 20 are coupled with first plug connection terminals P2 mounted to the connection plug P. Here, since the first connection terminals 20 are shorter than the second connection terminals 30, the first plug connection terminals P2 may be connected with the first connection terminals 20 inside the case 11.

Referring to FIG. 6C, the second connection terminals 30 may be connected with second plug connection terminals P3 mounted to the connection plug P. Since the second connection terminals 30 are relatively longer, the second plug connection terminals P3 may be connected with the second connection terminals 30 at an insertion side of the case 11.

Here, the ribs 18 and the cover rib 19 prevent separation of the first and second connection terminals 20 and 30 from the mounting case 15. Also, the ribs 18 and the cover rib 19 may prevent interference between the first and second connection terminals 20 and 30 and the first and second plug connection terminals P2 and P3.

Therefore, when the connection plug P is inserted in the connection socket 10, the first and second connection terminals 20 and 30 disposed on one plane and the first and second plug connection terminals P3 and P4 of the connection plug P may be stably connected in different positions without interfering with each other.

Thus, the connection socket 10 according to the present invention may be manufactured to be slim even though different types of connection terminals are mounted and connected to two different connection plugs on one plane.

Although a few exemplary embodiments of the present invention have been shown and described, the present invention is not limited to the described exemplary embodiments. Instead, it would be appreciated by those skilled in the art that changes may be made to these exemplary embodiments without departing from the principles and spirit of the invention, the scope of which is defined by the claims and their equivalents.

What is claimed is:

1. A connection socket for a portable terminal, comprising:
a case having:
(a) a mounting case including:
(1) a first mounting portion and a second mounting portion formed, respectively, corresponding to lengths of the connection terminals, and
(2) a third mounting portion extended to the first mounting portion and the second mounting portion; and
(b) a cover case configured to protect the connection terminals by enclosing the mounting case and to fix the mounting case by the third mounting portion; and
a plurality of socket connection terminals of different types having portions disposed on one plane in the case and adapted to be connected with plug connection terminals mounted to a connection plug in different positions
wherein:
(a) first connection terminals are mounted to the first mounting portion,
(b) second connection terminal are mounted to the second mounting portion, and
(c) the first connection terminals are formed shorter than the second connection terminals; and
(d) the second mounting portion comprises a cover rib extended at an upper surface of the second connection terminals in the same length as the first connection terminals to cover the upper surfaces of the second connection terminals.

2. The connection socket of claim 1, wherein the plurality of connection terminals are in different lengths.

3. The connection socket of claim 2, wherein:
(a) the cover case comprises a case fixing projection formed by cutting and bending inwardly both sides of the cover case to be inserted in the mounting case, and
(b) the third mounting portion comprises a case fixing recess for insertion of the case fixing projection.

4. The connection socket of claim 2, wherein the first connection terminals are disposed along sides of the second connection terminals, respectively.

5. The connection socket of claim 2, wherein the mounting case comprises ribs protruding between respective ones of the first connection terminals and the second connection terminals.

6. The connection socket of claim 2, wherein the cover case comprises an entry prevention projection protruding downward from an upper inner surface to guide an entry position of the connection plug.

7. The connection socket of claim 2, wherein the mounting case is insert-molded so that the plurality of connection terminals are mounted to the mounting case.

8. The connection socket of claim 1, wherein the connection socket is engaged with the connection plug in which the plug connection terminals connected with the plurality of connection terminals are disposed on one plane.

9. A connection socket for a portable terminal comprising:
a case;
a first type of socket connection terminal:
(a) disposed in a plane with a portion of the first type socket connection terminal at a first position, and
(b) adapted to receive a plug for connection with a first connection terminal in the plug at a portion of the first type socket connection terminal; and
(c) a second type of socket connection terminal:
(1) disposed in the case on the same plane as the first type socket connection terminal with a portion of the second type socket connection terminal at a second position different from the position of the portion of the first type socket connection terminal, and
(2) adapted to receive the plug for connection with a second connection terminal in the plug at the portion of the second type socket connection terminal wherein:
(a) the length of the first type socket connection terminal is different from the length of the second type socket connection terminal;
(b) the case comprises a mounting case including:
(i) a first mounting portion and a second mounting portion formed, respectively, corresponding to the lengths of the first type socket connection terminal and the second type socket connection terminal, and
(ii) a third mounting portion extended to the first mounting portion and the second mounting portion; and
(iii) a cover case configured to protect the first type socket connection terminal and the second type socket connection terminal by enclosing the mounting case and to fix the mounting case by the third mounting portion; and
(c) the second mounting portion comprises a cover rib extended at an upper surface of the second type socket connection terminal in the same length as the first type socket connection terminal to cover the upper surface of the second type socket connection terminal.

10. The connection socket of claim 9 wherein:
(a) the cover case comprises a case fixing projection formed by cutting and bending inwardly both sides of the cover case to be inserted in the mounting case, and
(b) the third mounting portion comprises a case fixing recess for insertion of the case fixing projection.

11. The connection socket of claim 9 wherein:
(a) the first type socket connection terminal is mounted to the first mounting portion,
(b) the second type socket connection terminal is mounted to the second mounting portion, and (c) the first type socket connection terminal is formed shorter than the second type socket connection terminal.

12. The connection socket of claim 11 wherein the first type socket connection terminal is disposed along a side of the second type socket connection terminal.

13. The connection socket of claim 12 wherein the mounting case comprises a rib protruding between the first type socket connection terminal and the second type socket connection terminal.

14. The connection socket of claim 9 wherein the cover case comprises an entry prevention projection protruding downward from an upper inner surface to guide an entry position of the connection plug.

15. The connection socket of claim 9 wherein the mounting case is insert-molded so that socket connection terminals are mounted to the mounting case.

* * * * *